US007527472B2

(12) United States Patent
Allen

(10) Patent No.: US 7,527,472 B2
(45) Date of Patent: May 5, 2009

(54) THERMALLY SPRAYED CONFORMAL SEAL

(75) Inventor: David B. Allen, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 434 days.

(21) Appl. No.: 11/509,232

(22) Filed: Aug. 24, 2006

(65) Prior Publication Data

US 2008/0050236 A1 Feb. 28, 2008

(51) Int. Cl.
*F01D 9/04* (2006.01)

(52) U.S. Cl. ..... 415/139; 415/200; 415/191; 415/211.2; 277/648; 277/654

(58) Field of Classification Search ..... 415/139, 415/191, 211.2, 200; 277/641, 643, 648, 277/654
See application file for complete search history.

(56) References Cited

U.S. PATENT DOCUMENTS 4,114,248 A 9/1978 Smith et al.
4,524,980 A 6/1985 Lillibridge et al.
4,576,548 A 3/1986 Smed et al.
4,897,021 A 1/1990 Chaplin et al.
5,167,485 A * 12/1992 Starkweather ..... 415/115
5,221,096 A 6/1993 Heldreth et al.
5,590,887 A 1/1997 Senda et al.
5,624,227 A 4/1997 Farrell
5,634,766 A 6/1997 Cunha et al.
5,705,281 A 1/1998 Reeves et al.
5,709,530 A 1/1998 Cahill et al.
5,749,701 A 5/1998 Clarke et al.
5,823,741 A 10/1998 Predmore et al.
5,839,663 A 11/1998 Broadway et al.
5,932,356 A 8/1999 Silco et al.
5,975,844 A 11/1999 Milazar et al.
6,340,285 B1 * 1/2002 Gonyou et al. ..... 415/116
6,352,264 B1 3/2002 Dalzell, Jr. et al.
6,418,727 B1 7/2002 Rice et al.
6,488,992 B1 12/2002 Boerio et al.
6,610,416 B2 8/2003 Wallace et al.
6,652,231 B2 11/2003 Vedantam et al.
6,843,479 B2 1/2005 Burdgick
6,857,849 B2 2/2005 Hirst
6,883,807 B2 4/2005 Smed
6,913,265 B2 7/2005 Datta
6,968,615 B1 11/2005 More et al.
7,001,145 B2 2/2006 Couture et al.
7,040,857 B2 5/2006 Chiu et al.

* cited by examiner

*Primary Examiner*—Ninh H Nguyen

(57) ABSTRACT

A conformal seal (20) for sealing air flow between a cooling airflow path and a hot gas flow path within a combustion turbine engine. The conformal seal (20) may be fitted within cooperating side slots of adjacent vane segments (10) within the combustion turbine engine. The conformal seal (20) may include an elongated metallic substrate (22, 40) forming an upper surface and a lower surface. A conformal coating (26, 44) may be deposited over one or both surfaces of the substrate (22, 40). The conformal coating (26, 44) may be deposited to a depth so that a point contact between the conformal coating (26, 44) and respective interior walls of the side slots wears the conformal coating (26, 44) to establish surface area contact there between. The surface area contact improves a sealing function between the conformal coating (26, 44) and the respective interior walls during operation of the combustion turbine engine.

20 Claims, 2 Drawing Sheets

THERMALLY SPRAYED CONFORMAL SEAL

FIELD OF THE INVENTION

This invention relates generally to combustion turbine engines and in particular to seals used within the gas flow path for inhibiting the leakage of combustion gases between or among components within the combustion turbine engine.

BACKGROUND OF THE INVENTION

Combustion turbine engines such as ones used for power generation define cooling air and combustion gas flow paths that need to be separated from one another for optimum operating efficiency. Gas turbine engines may have high turbine inlet temperatures, which cause thermal expansion of individual components. In such cases, adjacent components are sometimes spaced from one another to avoid high thermal stresses and the formation of cracks during operation. Gaps may be formed between components that would allow for the undesirable passage of combustion gases or cooling airflow if the gap were not adequately sealed.

DETAILED DESCRIPTION OF THE INVENTION

Interstage gas leakage between and around components is deleterious to combustion turbine engine performance, efficiency and emissions. Leakage reduction may be achieved by using various seals such as solid metal flat seals, riffle seals, and various spring seals, among others. The inventor has determined that certain types of these seals frequently suffer from a certain amount of "bridging", which may result from adjacent components twisting during operation. If two adjacent components, such as vane segments of a combustion turbine engine, for example, between which the seal interfaces are twisted or not perfectly parallel the seal will tend to form a straight-line path between the components resulting in increased leakage through that path. Twisting has been observed in combustion engine components due to thermal deflection and off-axial aero loading.

Figure 1:
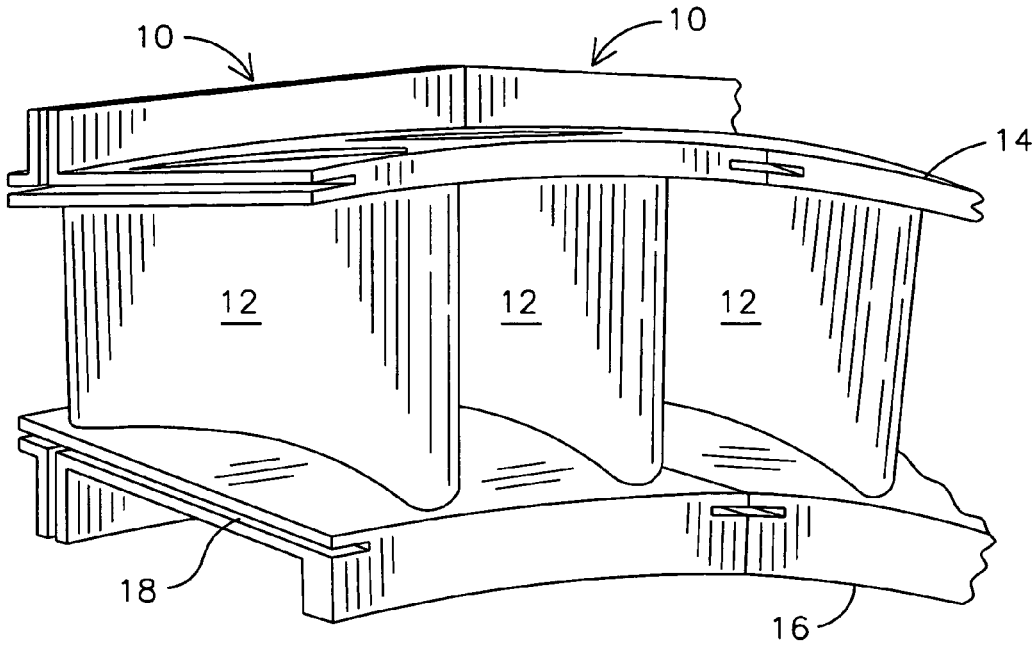
FIG. 1 is a perspective view of vane ring segments for use within a combustion turbine engine.

Embodiments of the invention may be used in a wide range of operating environments including combustion turbine engines used in power plants as recognized by those skilled in the art. FIG. 1 illustrates a set of vane segments 10 that may be used to form a completed ring of vanes within a combustion turbine engine. Vane segments 10 may include a plurality of individual vanes 12 supported between an upper support structure 14 and a lower support structure 16. A plurality of vane segments 10 may be abutted together to form a completed vane ring.

A plurality of completed vane rings is typically used within the turbine section of a combustion turbine engine used for power generation. An exemplary combustion turbine engine known in the industry is a W501G sold by the assignee of the present invention. The hot gas path temperature of such an engine may operate in temperatures around 1100° C.-1500° C. During operation of a combustion turbine engine, cooling air may be directed to pass within vanes 12 to maintain them at a desirable operating temperature. The cooling air temperature is typically around 450° C. Under these operating conditions, it is advantageous to prevent the cooling air from leaking into the hot gas path flow through the combustion turbine engine because this leads to inefficiencies in the performance of the engine.

Figure 2:
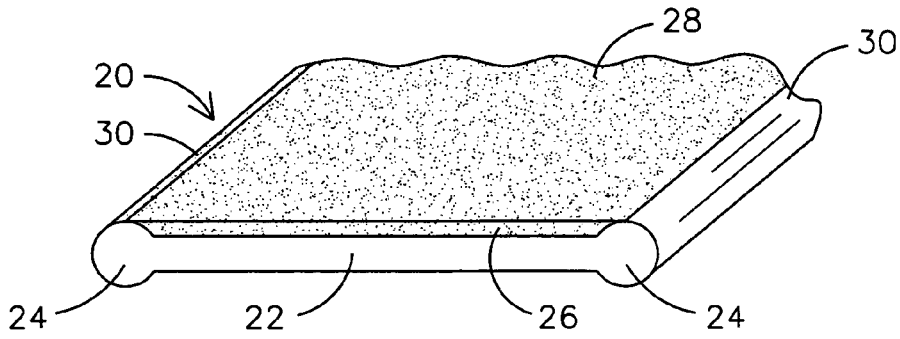
FIG. 2 is a fragmented perspective view of an exemplary embodiment of a conformal seal.

FIG. 1 shows a side slot 18 formed within vane segment 10, which experiences an operating temperature of around 650° C. Side slots 18 may be formed within each side of vane segments 10 so that when adjacent vane segments 10 are abutted against one another respective side slots 18 of each vane segment 10 will align with one another. FIG. 2 illustrates an exemplary embodiment of a conformal seal 20, which may be a vane side seal that may be inserted within respective side slots 18 of adjacent vane segments 10. The conformal seal 20 of FIG. 2 may include an elongated substrate 22, which may be a metallic "dog bone" seal having pontoon shaped elongated protrusions 24 extending the length of the longitudinal axis of substrate 22. Conformal seal 20 may extend the entire length of side slots 18.

Over time, the relative movement (vibration) of engine components and various seal surfaces will cause wear of one or both seal surfaces mating with the components. This is desirable from a sealing standpoint, as it provides reduced interstage gas leakage due to the increased contact area between the worn-in sealing faces and the components. However, with uncoated solid metal seals the wear-in rate is very slow, requiring thousands or tens of thousands of hours to achieve a well-mated surface area between the seal faces and components, which reduces air leakage. Embodiments of the invention allow for depositing a softer material that may be more easily worn-in on one or both surfaces of a seal, thus facilitating faster wear-in of the contact surfaces and providing improved sealing via larger surface area contact.

A layer of conformal coating 26 may be deposited upon a commercially available seal material, such as Hastelloy-X nickel superalloy forming substrate 20 and protrusions 24. Conformal coating 26 may be deposited on an upper and/or lower surface of substrate 22 between protrusions 24. Coating 26 may be deposited to a depth such that an upper surface 28 of coating 26 is substantially flush with or slightly below the upper surfaces 30 of protrusions 24.

In this aspect, upper surfaces 30 may establish point or line contact with the interior walls of respective side slots 18 when conformal seal 20 is installed within slots 18. As the point or line contact areas of upper surfaces 30 wear over time against the interior walls of respective side slots 18, surface area contact will be established there between that is larger than the amount of point or line contact established with upper surfaces 30 in an original condition. Over time, the interior walls of respective side slots 18 will rub or engage conformal coating 26 thereby creating surface area contacts there between, which may be larger than those established between upper surfaces 30 on the interior walls of respective side slots 18. These larger surface area contacts ensure an efficient sealing function is established and maintained even though the upper surfaces 30 and other portions of protrusions 24 are worn away over time.

In alternate embodiments upper surface 28 of conformal coating 26 may extend over and cover upper surfaces 30 of protrusions 24 to a desired thickness. In this aspect, the initial point or line contact is between upper surface 28 of coating 26 extending over upper surfaces 30 and the interior walls of respective side slots 18. Coating 26 may be deposited to a depth so that a point contact between conformal coating 26 and respective interior walls of side slots 18 wears conformal coating 26 to establish surface area contact to improve a sealing function between conformal coating 26 and the respective interior walls during operation of a combustion turbine engine.

Embodiments of conformal seal 20 allow for improved sealing efficiencies between adjacent vane segments 10, which may be cast from a nickel or cobalt-based superalloy. Examples of each are IN939 and X45, respectively. In one aspect of the invention, the faces of substrate 22 to be coated may be grit blasted prior to deposition of coating 26. A metal bond coating such as a first layer of MCrAlY (M=Ni, Co or both) or a similar oxidation-resistant alloy may be sprayed onto the grit blasted surface via either a high velocity thermal spray process such as HVOF (high velocity oxy-fuel) or via a lower velocity process such as APS (atmospheric plasma spray). The first layer of MCrAlY may have a first density of approximately 95% or greater, the density expressed as actual coating density/theoretical density. The first layer of MCrAlY is effective as a bond coat for bonding conformal coating 26 with substrate 22.

Conformal coating 26 may be sprayed onto the metal coating using a low velocity process such as APS or combustion flame spray, and may be a second layer of MCrAlY having a second density that is less than the first density of the first layer. The second density may be in the range of approximately 65%-85%, the density expressed as actual coating density/theoretical density. Conformal coating 26 may be sprayed to achieve a relatively high percentage of porosity in the range of about 15%-35% and in an embodiment the coating has about a 25% pore volume. This may be accomplished adjusting the spray parameters to produce a porous coating or by introducing a fugitive material during deposition such as exemplary materials polyester, Lucite and graphite either alone or in combination. A thermally grown oxide (TGO) layer may form within an upper surface area of conformal coating 26 that provides oxidation resistance for coating 26 during the useful life of conformal seal 20. The TGO layer may be formed as a cobalt based oxide, alumina or other oxidation resistant compounds.

Embodiments allow for improved sealing in various situations within a combustion turbine engine such as between adjacent components subject to twisting during operation of the engine. Conformal coating 26 may be deposited as a relatively soft material, such as one having a Rockwell superficial hardness of 30-70 HR15Y on one or more surfaces of a solid metal seal. When the two adjacent components, such as adjacent vane segments 10 twist, the soft coating 26 will conform or indent in response to the twisting component contacting a surface or surfaces of coating 26.

With respect to adjacent vane segments 10, the twisted configuration is the stable running configuration of the component structure. Thus, conformal seal 20 will adapt a shape in response to the twisting that provides improved sealing efficiency for the majority of the combustion turbine engine's operational time. Further, as adjacent vane segments 10 vibrate against one another during operation, conformal seal 20 will continue to wear-in as portions of vane segments 10 rub against conformal coating 26 thereby increasing the sealing efficiency further. This increased sealing efficiency and improved wear-in rate are primary benefits of a conformal seal such as shown by 20.

For example, an uncoated solid metal dog bone seal used within side slots 18 between adjacent vane segments 10 may take thousands of hours to wear-in whereas to establish an operational seal. Embodiments of conformal seal 20 will take far less time to wear-in and in at least one embodiment may take approximately 40 hours to wear-in. In addition to a much faster wear-in rate, surface area contact between conformal coating 26 and a may be larger than in the absence of the coating. Thus, a more efficient seal is established in a shorter period of time.

The exemplary conformal seal 20 of FIG. 2 illustrates that the conformal coating 26 may be deposited to fill the depression or cavity area of substrate 22 defined between the lengths of protrusions 24. Conformal coating 26 may be deposited to a depth equivalent to the upper surfaces 30 of protrusions 24, which typically establish points of contact with respective slots 18 when inserted therein. This allows for the conformal seal 20 to be installed into slots 18 using conventional techniques.

Embodiments allow for conformal coating 26 to be thermally sprayed to a thickness of approximately 1 mm although other application specific thicknesses may be used. Coating 26 may be a layer of CoNiCrAlY—hexagonal boron nitride (hBN)—polyester, such as a commercial product of the Sulzer Metco Corporation (2042) and may be sprayed into the center or cavity area of substrate 22. Substrate 22 may be a conventional vane dog bone side seal used within respective slots 18 between adjacent vane segments 10. Conformal coating 26 may be made of other suitable coating materials for use in application specific temperature environments. Such materials must be sufficiently soft to abrade via oscillatory wear and have sufficient temperature capability to survive the desired number of hours at the intended operating temperature.

Figure 3:
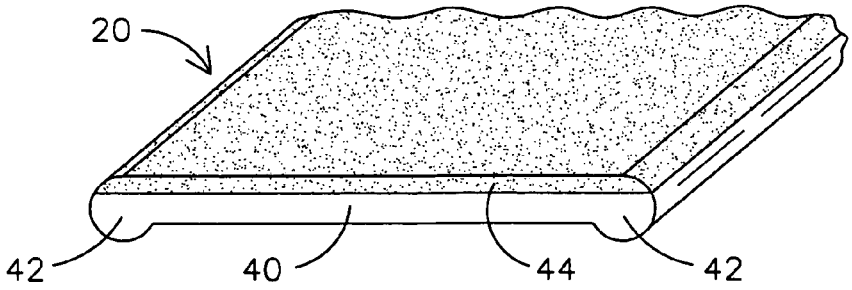
FIG. 3 is a fragmented perspective view of an exemplary embodiment of a conformal seal.
Figure 4:
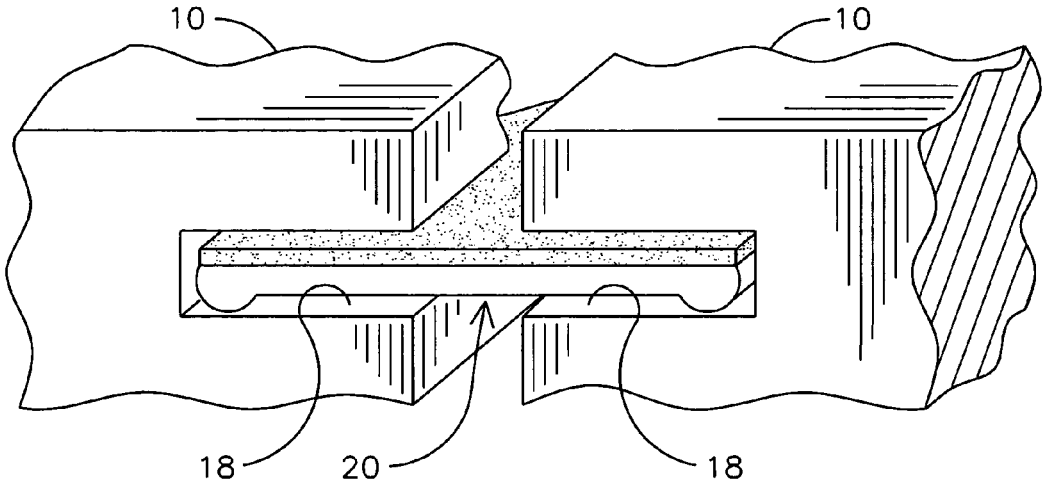
FIG. 4 is a fragmented perspective view of an exemplary embodiment of a conformal seal positioned within respective side slots of a vane segment.

FIG. 3 illustrates an exemplary embodiment of a conformal seal 20 that may include a substrate 40, which may be half of the metallic dog bone seal shown in FIG. 2 having pontoon shaped protrusions 42 extending the length of the lower half of the longitudinal axis of substrate 40. A layer of conformal coating 44 may be deposited on the upper surface of substrate 40 with coating 44 spanning the width and length of substrate 22. This embodiment of conformal seal 20 is shown installed within respective slots 18 of adjacent vane segments 10 in FIG. 4. Conformal coating 44 may be deposited to varying depths so that conformal seal 20 may be accommodated within respective slots 18.

A conventional uncoated metallic dog bone side seal would be sized smaller than the space defined by respective side slots 18 in adjacent vane segments 10 so the seal may be installed within those slots. When the combustion turbine engine is in operation the seal will be urged upwardly via a pressure differential and the upper surfaces 30 of the FIG. 2 embodiment will abut the interior walls of respective side slots 18 to create point and/or line contact continuously or intermittently along the length of surfaces 30. During operation, adjacent vane segments 10 will twist relative to one another, which causes gaps between the upper surfaces 30 and the interior walls of respective side slots 18 allowing cooling air to leak into the hot gas path of a turbine.

Figure 5:
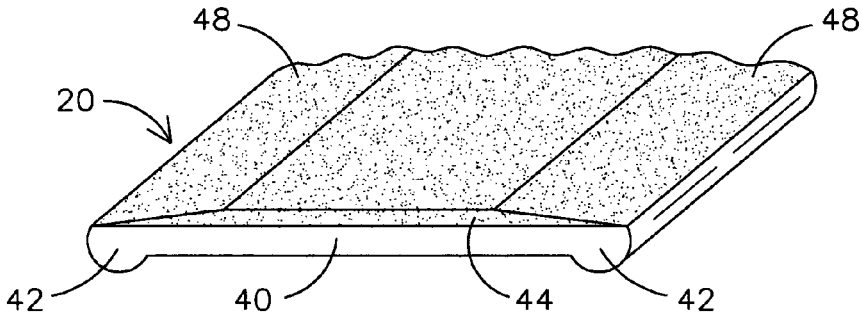
FIG. 5 is illustrative of a wear pattern of an exemplary embodiment of a conformal seal.

Embodiments of conformal seal 20 ensure that such gaps are avoided by providing a conformal layer 26, 44 on a substrate 22, 40 that contacts regions of the interior walls of respective slots 18. FIG. 5 is illustrative of prospective wear patterns on conformal seal 20 of FIG. 4 installed within respective slots 18 of adjacent vane segments 10. FIG. 5 illustrates that respective surface areas forming bevels 48 may be formed along the length of substrate 40 in response to the interior walls of respective slots 18 rubbing against conformal coating 44 during operation of a combustion turbine engine. It will be appreciated that bevels 48 are shown for illustrative purposes and that other wear patterns may emerge depending on the application of conformal seal 20. For example, diagonally opposed wear facets (top-right-front and bottom-left-rear) are also commonly observed in solid metal seals removed from field engines.

Further, conformal seal 20 used within respective side slots 18 of adjacent vane segments 10 may experience varying surface area wear patterns along the conformal coating 26, 44 depending on the dynamic response of conformal seal 20 when vane segments 10 undergo twisting during operation of a combustion turbine engine. Alternate surface area wear patterns may emerge depending on the specific operating environment within which conformal seal 20 is used, the depth and composition of conformal coating 26, 44 and the composition and dimensions of substrate 22, 40.

Figure 6:
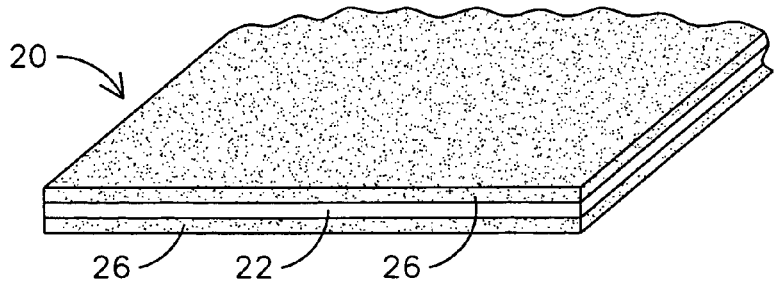
FIG. 6 is a fragmented perspective view of an exemplary embodiment of a conformal seal with conformal material on both of its surfaces.

FIG. 6 illustrates another exemplary embodiment of a conformal seal 20 that includes a substrate 22 and a conformal coating 26 deposited on both the upper and lower surfaces of substrate 22. In various embodiments, conformal coating 26 may be deposited over a portion the upper surface and/or the lower surface of substrate 22, 40 to a depth so that an initial point or line contact is established between coating 26 and respective interior walls of the side slots 18. The initial point or line contact may vary in size and location depending on the application and wears conformal coating 26 over time to establish surface area contact there between. This improves a sealing function between conformal coating 26 and the respective interior walls during operation of the combustion turbine engine.

Testing conducted to date indicates that embodiments of the invention may be used to improve sealing efficiency in various areas of combustion turbine engines under fretting and other wear conditions. Exemplary embodiments of conformal seal 20 may be used as side seals, ring segment circumferential seals, transition side seals, or vane key seals, as well as various other seals found within a combustion turbine engine.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

I claim as my invention:

1. An apparatus for sealing air flow between a cooling air flow path and a hot gas flow path within a combustion turbine engine, the apparatus fitted within cooperating side slots of adjacent vane segments within the combustion turbine engine, the apparatus comprising:

an elongated metallic substrate forming an upper surface and a lower surface; and a conformal coating deposited over a portion of at least one of the upper surface and the lower surface, the conformal coating deposited to a depth so that a point contact between the conformal coating and respective interior walls of the side slots wears the conformal coating to establish surface area contact to improve a sealing function between the conformal coating and the respective interior walls during operation of the combustion turbine engine.

2. The apparatus of claim 1 further comprising:

a metal coating deposited over the portion of at least one of the upper surface and the lower surface; and the conformal coating deposited on top of the metal coating.

3. The apparatus of claim 2 further comprising the conformal coating comprising a porosity of between about 15%-35% pore volume.

4. The apparatus of claim 3 further comprising the conformal coating comprising a quantity of a fugitive material suitable for forming the porosity of approximately 15%-35% pore volume.

5. The apparatus of claim 1 further comprising the elongated metallic substrate including a pair of longitudinally extending protrusions wherein the conformal coating is deposited between the pair of longitudinally extending protrusions.

6. The apparatus of claim 5 further comprising the conformal coating deposited to cover at least a portion of an upper surface of at least one of the pair of longitudinally extending protrusions.

7. The apparatus of claim 5 further comprising the conformal coating deposited between the pair of longitudinally extending protrusions so that an upper surface of the conformal coating is substantially flush with a respective upper surface of at least one of the pair of longitudinally extending protrusions.

8. The apparatus of claim 7 further comprising the conformal coating comprising a porosity of approximately 15%-35% pore volume.

9. The apparatus of claim 8 further comprising the conformal coating comprising a quantity of a fugitive material suitable to form the porosity of approximately 25% pore volume.

10. The apparatus of claim 1 further comprising the conformal coating comprising a layer of MCrAlY containing hexagonal boron nitride and polyester.

11. A seal for positioning between a pair of adjacent vane segments subjected to vibrational movement during operation of a combustion turbine engine, the seal comprising:

a metallic substrate formed to be inserted between the pair of adjacent vane segments;

a first layer of MCrAlY having a first density deposited on at least one surface of the metallic substrate; and a second layer of MCrAlY having a second density deposited on the first layer of MCrAlY, wherein the first density is greater than the second density.

12. The seal of claim 11 further comprising the first density being about 95% or greater and the second density being between about 65%-85%.

13. The seal of claim 11 further comprising the second layer of MCrAlY comprising CoNiCrAlY, a quantity of hexagonal boron nitride and a quantity of polyester material deposited on the first layer of MCrAlY so that the second layer of MCrAlY has a pore volume of between about 15%-35%.

14. The seal of claim 11 further comprising the first layer of MCrAlY and the second layer of MCrAlY deposited to a thickness so that an interior wall portion of at least one of the pair of adjacent vane segments engages the second layer of MCrAlY in response to vibrational movement during operation of the combustion turbine engine to establish surface area contact between the second layer of MCrAlY and the interior wall portion to improve a sealing function there between.

15. The seal of claim 14 further comprising the metallic substrate forming a dog bone configuration for fitting within respective side slots of the pair of adjacent vane segments within the combustion turbine engine.

16. A seal for use between adjacent vane segments in a combustion turbine engine, the seal comprising:

a substrate; and at least one layer of an abradable material deposited on at least one surface of the substrate, the at least one layer deposited to a depth so that a point contact between the at least one layer and respective interior walls of the adjacent vane segments wears the at least one layer to establish surface area contact there between to improve a sealing function between the at least one layer and the respective interior walls during operation of the combustion turbine engine.

17. The seal of claim 16, the at least one layer of abradable material comprising:

a first layer of MCrAlY having a first density deposited on at least one surface of the substrate; and a second layer of MCrAlY having a second density deposited over the first layer of MCrAlY, wherein the first density is greater than the second density.

18. The seal of claim 17 further comprising the first density being about 95% or greater and the second density being between about 65%-85%.

19. The seal of claim 16 further comprising the substrate sized to fit within cooperating side slots of the adjacent vane segments and including a pair of longitudinally extending protrusions wherein the at least one layer is deposited at least between the pair of longitudinally extending protrusions.

20. The seal of claim 16 further comprising the substrate being substantially rectangular and sized to fit within cooperating side slots of the adjacent vane segments and the at least one layer deposited on an upper surface and a lower surface of the substrate.

* * * * *